US005462353A

United States Patent [19]

Gatlin

[11] Patent Number: 5,462,353

[45] Date of Patent: Oct. 31, 1995

[54] SHAKER WITH CAM OPERATED CLAMP

[75] Inventor: Noel A. Gatlin, Clifton, Ill.

[73] Assignee: United Coatings, Inc., Kankakee, Ill.

[21] Appl. No.: 209,145

[22] Filed: Mar. 10, 1994

[51] Int. Cl.[6] ..... B01F 11/00

[52] U.S. Cl. ..... 366/209; 366/605

[58] Field of Search ..... 366/110, 111, 366/128, 208–217, 605

[56] References Cited

U.S. PATENT DOCUMENTS

| | | | |
|---|---|---|---|
| D. 254,973 | 5/1980 | Ahrenskou-Sörensen . | |
| 835,846 | 11/1906 | Blaloch . | |
| 1,448,446 | 3/1923 | Hulbert . | |
| 1,463,626 | 7/1923 | Marrazzo . | |
| 1,755,763 | 4/1930 | Barber . | |
| 2,797,902 | 7/1957 | Buegler . | |
| 2,894,309 | 7/1959 | Brzowski . | |
| 3,018,092 | 1/1962 | Johnson . | |
| 3,181,841 | 5/1965 | Boehm . | |
| 3,229,964 | 1/1966 | Wiseman . | |
| 3,265,366 | 8/1966 | Warner . | |
| 3,284,057 | 11/1966 | Duquette . | |
| 3,301,534 | 1/1967 | Orser . | |
| 3,388,895 | 6/1968 | Ogren et al. . | |
| 3,415,495 | 12/1968 | Grubelic . | |
| 3,421,053 | 1/1969 | Rinard et al. . | |
| 3,437,317 | 4/1969 | Micin . | |
| 3,480,259 | 11/1969 | Schletz . | |
| 3,542,344 | 11/1970 | Oberhauser . | |
| 3,609,921 | 10/1971 | Foster et al. . | |
| 3,706,443 | 12/1972 | Oberhauser . | |
| 3,735,962 | 5/1973 | Pagano . | |
| 3,880,408 | 4/1975 | Karjalainen . | |
| 4,134,689 | 1/1979 | Ahrenskou-Sörensen . | |
| 4,146,335 | 3/1979 | Hutchings et al. . | |
| 4,235,553 | 11/1980 | Gall . | |
| 4,281,936 | 8/1981 | Schotter et al. . | |
| 4,415,270 | 11/1983 | Heinis et al. . | |
| 4,422,768 | 12/1983 | Soloman . | |
| 4,497,581 | 2/1985 | Miller . | |
| 4,588,302 | 5/1986 | Pizzi et al. | 366/209 X |
| 4,662,760 | 5/1987 | Powell . | |
| 4,789,245 | 12/1988 | Morbeck . | |
| 4,842,415 | 6/1989 | Cane et al. . | |
| 5,066,136 | 11/1991 | Johnson | 366/209 |
| 5,197,802 | 3/1993 | Miller et al. | 366/605 X |

FOREIGN PATENT DOCUMENTS

| | | | |
|---|---|---|---|
| 478864 | 1/1938 | United Kingdom . | |
| 9108045 | 6/1991 | WIPO | 366/605 |

*Primary Examiner*—Charles E. Cooley
*Attorney, Agent, or Firm*—Welsh & Katz, Ltd.

[57] ABSTRACT

A mixing apparatus for mixing paints contained within one or more containers. The mixing apparatus has an inner frame with a removable shelf to support the container. The mixing apparatus also has a cam-operated clamping device to selectively clamp the paint container to the shelf and a drive assembly to agitate the inner frame to mix the paint within the container. The clamping device may be selectively configured to accommodate paint containers of different heights.

11 Claims, 5 Drawing Sheets

SHAKER WITH CAM OPERATED CLAMP

FIELD OF THE INVENTION

This invention generally relates to a mixing apparatus for mixing the contents within containers through agitation or shaking of the container and more specifically to an apparatus for mixing paints which are contained within containers.

BACKGROUND OF THE INVENTION

In the retail sale of paints within containers such as One-gallon cans, the paint within the container typically must be mixed prior to use by the purchaser. Such mixing is typically done by mechanical mixers which shake the containers to agitate the contents. In many of the stores which distribute paints, the number of containers sold during the day make it desirable that the mixing apparatus be capable of mixing the paint quickly.

Paints are also sold in containers of different sizes. Thus it is also desirable that the paint mixing apparatus be capable of mixing containers of different sizes. Also, a purchaser may purchase a number of containers of the same size. Therefore, to reduce the amount of time necessary to mix a number of containers it is also desirable that the mixing apparatus be capable of mixing multiple containers simultaneously.

In addition to the above noted attributes, it is also desirable that any mixing apparatus be easy to use. Preferably the apparatus is of a type which may be operated by a relatively unsophisticated operator and also include safeguards which reduce the risk of injury either to the operator or paint container.

It is therefore an object of the present invention to provide an improved mixing apparatus. A related object is to provide such a mixing apparatus which is particularly suited to the mixing of containers of paints.

It is also an object of the present invention to provide an improved mixing apparatus which quickly mixes the paint within the containers.

It is a further object of the present invention to provide an improved mixing device which is particularly suited to mixing paint containers of different sizes. A related object is to provide such a mixing apparatus which can also mix a plurality of containers simultaneously.

It is a still further object of the present invention to provide an improved mixing device which may be operated by relatively unsophisticated operators. A related object is to provide such a mixing apparatus which includes safeguards to reduce the chance of injury to the operator and container.

SUMMARY OF THE INVENTION

Accordingly, the above-listed objects are met and exceeded by a mixing apparatus for mixing paint contained within one of more containers. The mixing apparatus has an inner frame and a shelf to support the container. The shelf is slidingly mounted to the inner frame so that the paint container may be easily placed on and removed from the mixing apparatus.

The mixing apparatus also has a clamping device to selectively clamp the paint container to the shelf. The clamping device includes an upper clamping lid movable to contact the container and clamp the container onto the shelf. A cam is operably connected to the clamping plate and is selectively rotated to force the clamping plate toward the container.

The mixing device also has a drive assembly to agitate the inner frame to mix the paint within the container. The drive assembly is mounted to an intermediate frame and preferably agitates the inner frame by rotating the lower end of the inner frame about an axis. The upper end of the inner frame being pivotally connected to the intermediate frame.

More particularly, the clamping lid is mounted on a shelving cage which is slidably connected to the inner frame. The shelving cage has a number of guide sets to which the clamping lid may be selectively attached to vary the distance between the lid and the shelf to accommodate paint containers of different heights. The cams operably contact the shelving cage.

The intermediate frame is preferably mounted to an outer frame by a number of shock absorbers to absorb the vibrations of the intermediate frame during the mixing of the paint container. To guard against splattering and for safety purposes, the outer frame includes a covering to form a cabinet, and the mixing assembly includes a control system to selectively activate the clamping device and agitating assembly.

DESCRIPTION OF THE PREFERRED EMBODIMENT

Figure 1:
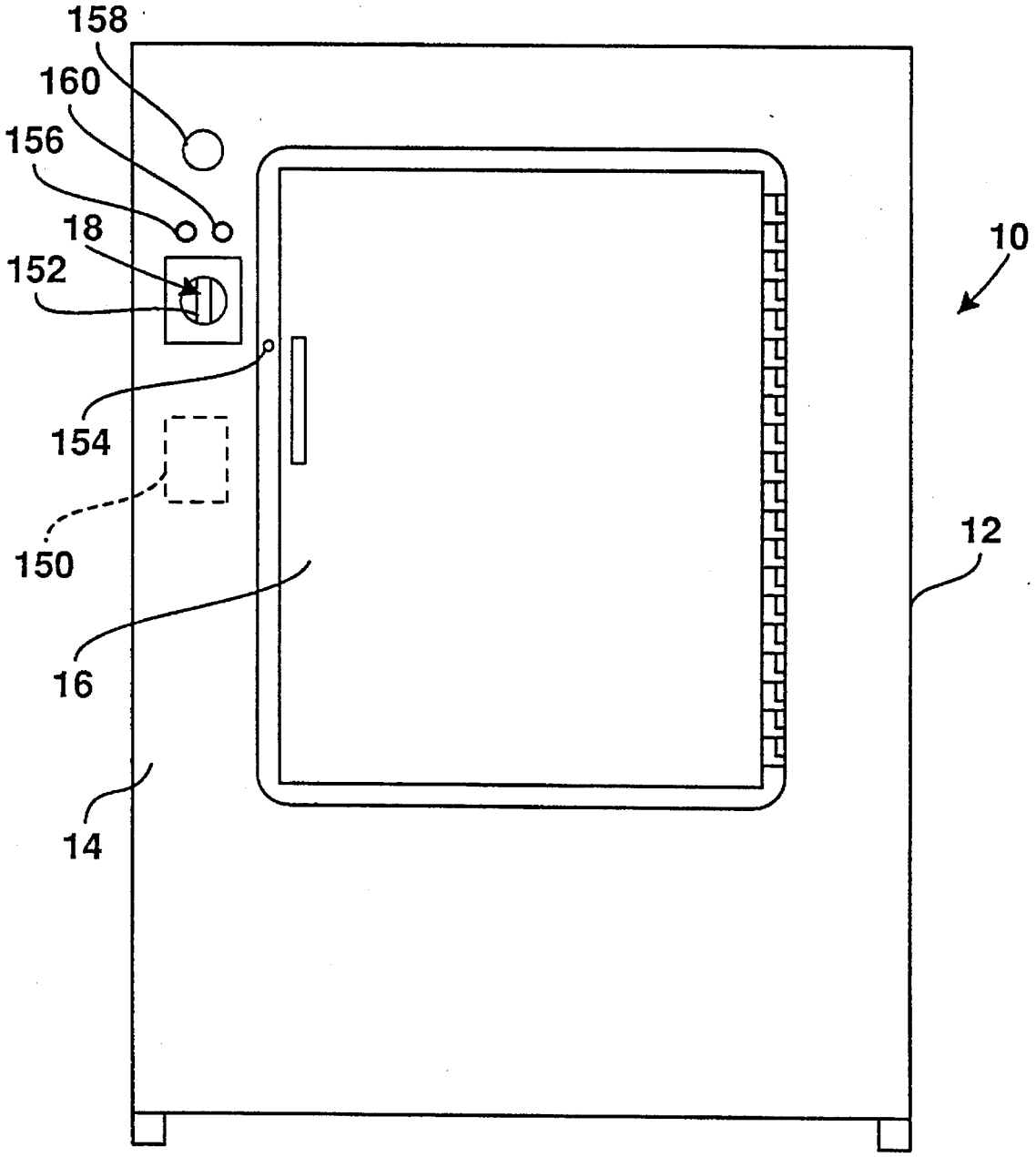
FIG. 1 is a front elevational view of the present container shaker.

Referring to FIG. 1, a paint shaker assembly according to the present invention is generally indicated at 10. The assembly 10 has an outer cabinet 12 to prevent the splattering of paint about the environment should a paint container leak during mixing. The housing 12 has a front panel 14 with a hatch door 16 for access to an interior compartment formed by the cabinet 12. Housed within sockets formed on the upper corner of a front panel 14 are the controls, indicated generally at 18, for the mixing assembly 10.

Figure 2:
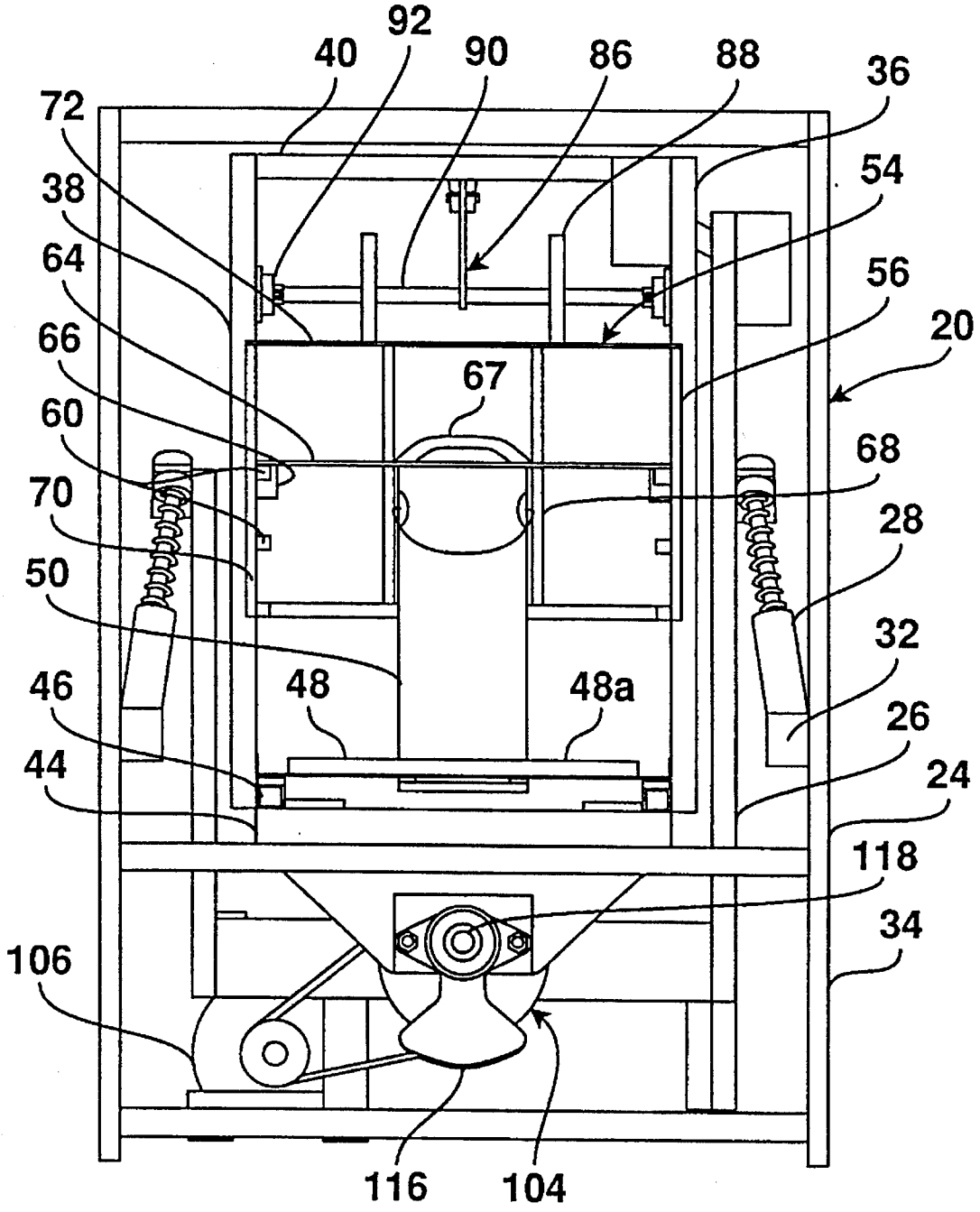
FIG. 2 is the shaker of FIG. 1 with the front panel removed to illustrate the elements contained therein.

Referring to FIG. 2, a mixing apparatus 20, is illustrated. The apparatus 20 has an outer, generally rectangular rigid frame 24 which preferably forms the structure for the cabinet 12. Within the outer frame is an intermediate, generally rectangular rigid frame 26. The intermediate frame 26 is mounted to the outer frame 24 by a series of four shock and spring assemblies 28 which dampen the vibration of the intermediate frame relative to the outer frame.

Figure 3:
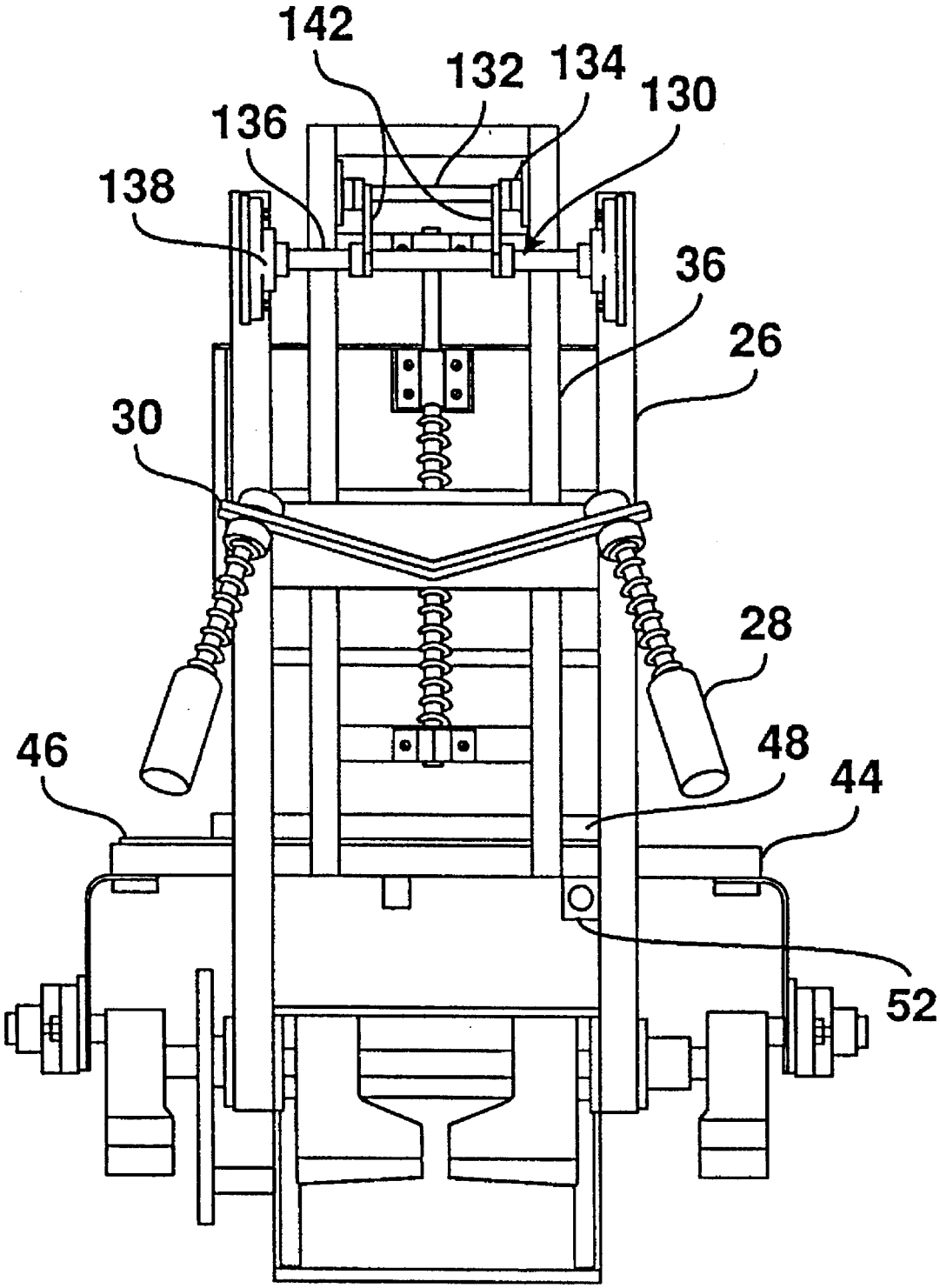
FIG. 3 is a left side elevational view with an outer frame, forming a part of the shaker of FIG. 1, removed for clarity.

Referring to FIG. 3 in conjunction with FIG. 2, preferably the shock assemblies 28 are arranged with a pair of the shock assemblies 28 attached to each side of the intermediate frame 26. For each pair, an upper end of each of the shocks 28 is attached to a horizontal brace 30 of the intermediate frame 26, and a lower end is attached to a bracket 32 attached to a vertical corner strut 34 of the outer frame 24. To stabilize and support the intermediate frame 26, the shocks 28 are angled outward so that the top end of the shocks are upward and inward of the bottom end.

Referring back to FIG. 2, movably attached to and disposed within the intermediate frame 26 is an inner frame 36. The inner frame 36 is generally vertically extending and includes four vertical corner struts 38 having top ends which are connected to each other by upper horizontal braces 40. The lower ends of the corner struts 38 are interconnected by lower horizontal braces 44.

Attached to and extending horizontally between the forward and rearward horizontal braces 44 is a pair of guide members 46. The guides 46 are preferably covered with a friction reducing surface such as nylon or the like. The guides 46 slidably support a shelf 48 having a flat, horizontal upper surface 48*a* to support a paint container 50 in an upright position. The shelf 48 is configured to slide forward on the guides 46 so that a front portion extends forward out of the cabinet 12 to facilitate insertion and removal of the paint container 50 from the mixing apparatus 20. The shelf 48 is preferably sized so that the shelf may support multiple containers 50 in an upright position. Referring to FIG. 3, attached to the lateral horizontal braces 44 are cam followers 52 which halt the forward movement of the shelf 48 after the shelf is moved forward a desired distance to prevent the shelf from being pulled out of the guides 46.

Referring back to FIG. 2, the inner frame 36 also has an assembly 54 for selectively clamping the paint container 50 to the shelf 48. The clamping assembly 54 includes an adjustable clamping cage 56. The clamping cage 56 is vertically movable within the corner struts 38. To provide for gross adjustment for containers 50 of differing heights, the cage 56 has at least one and preferably three sets of vertically spaced shelving guides 60. A clamping lid 64 is removably and slidably disposed on one of the sets of guides 60. Attached to the lower surface of the clamping lid 64 is a set of lateral brackets 66 to slidably receive the guides 60 and fixedly hold the lid against vertical displacement relative to the cage 56. The lid 64 may include a handle 67 for grasping.

Figure 4:
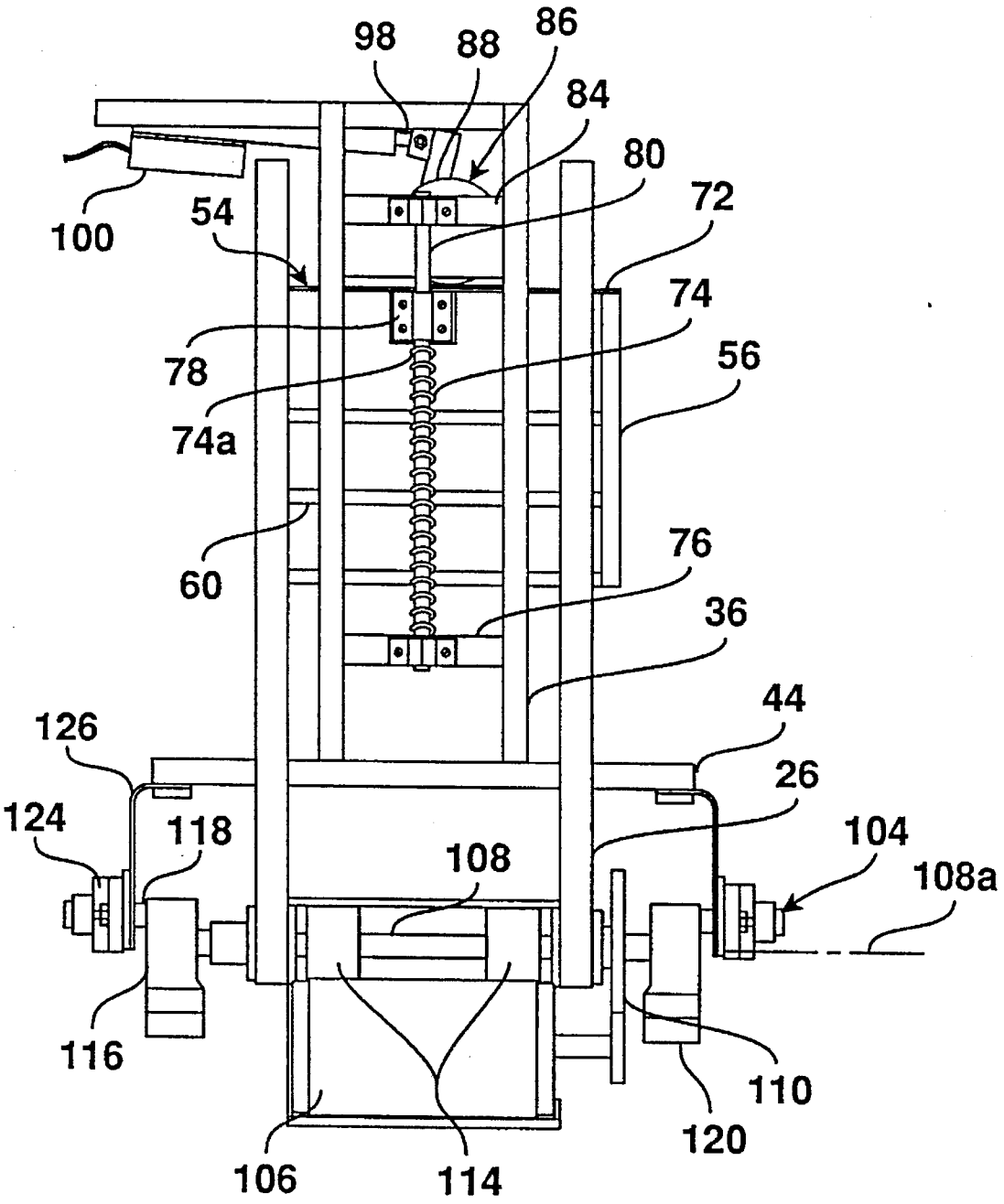
FIG. 4 is a right side elevational view of the shaker of FIG. 3.

The cage 56 also includes a pair of vertical rods 68 which form rearward stops for the clamping lid 64, and the guides 60 are mounted to four vertically extending corner posts 70. The upper ends of the posts 70 are attached to the four corners of a rectangular panel 72. Referring to FIG. 4, to biasingly support the cage 56 and hence the panel 72 in an up position so as to allow the paint container 50 to be placed on the shelf 48 between the shelf and panel, the clamping assembly 54 has a set of springs 74 connecting each of the lateral sides of the panel to a lower horizontal brace 76 on the inner frame 36. The biasing force applied by the springs 74 opposes downward movement of the clamping assembly.

The upper ends 74*a* of the springs 74 are attached to brackets 78 attached to each of the lateral sides of the panel 72. The brackets 78 may also be configured to slidingly cooperate with posts 80 which extend between the lower horizontal brace 76 and an upper horizontal brace 84. The cooperation between the brackets 76 and posts 80 guides the clamping device 56 along a desired travel path relative to the inner frame 36 as the cage 56 moves up and down.

Figure 5:
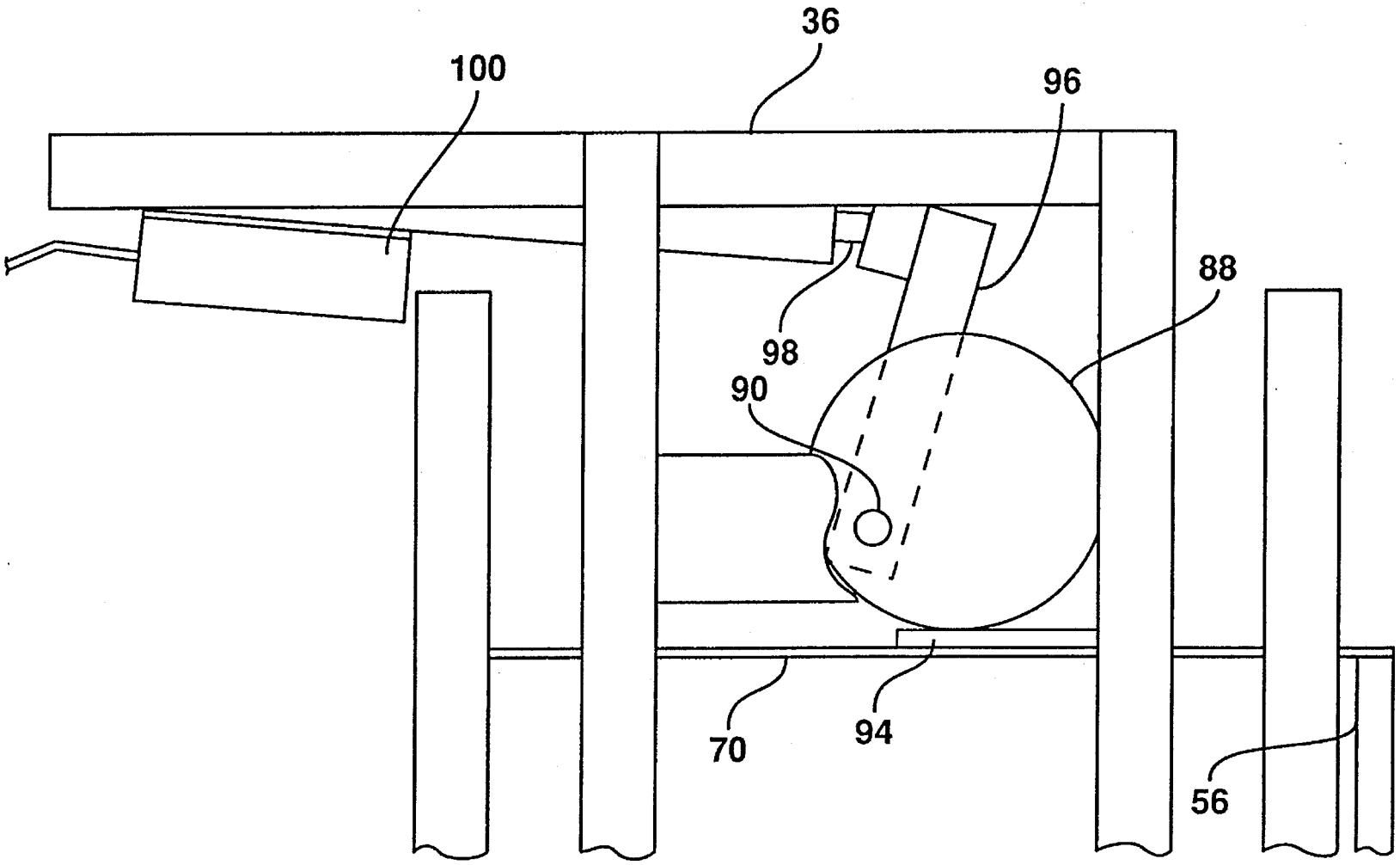
FIG. 5 is a partial side elevational view of the top portion of FIG. 4.

Referring to FIGS. 2 and 4, to force the cage 56 downward against the upward biasing force applied by the springs 74 and against the upper end of the paint container 50, the clamping assembly 54 has a camming mechanism 86. The camming mechanism 86 has a pair of cams 88 which are affixed to a shaft 90. The ends of the shaft 90 are journalled in bearings 92 attached to the inner frame 36. Referring to FIG. 5, the cams 88 contact a plate 94 covering a portion of the upper side of the panel 70, and the cams are configured so that rotation of the cams forces the panel 70, and therefore, the cage 56 downward.

To rotate the shaft 90 and cams 88, a linkage arm 96 has one end attached to the shaft 90 and the opposite end attached to the rod 98 of a linear drive device 100 such as a 24V DC, 75 lbs. push device or the like. The drive 100 is mounted to the upper end of the inner frame 36. The linear drive 100 has a slip clutch which is set so that when the resistance to further rotation of the shaft 90 exceeds a predetermined amount, corresponding to a desired clamping force exerted by the clamping device 56 on the paint container, further forward travel of the rod 98 is halted and the rod is maintained in the halted position.

Referring to FIG. 2, the cams 88 are configured so that upon the maximum extension of the rod 98 (FIG. 5) and hence maximum rotation of the cams, the clamping cage 56 is forced down a distance equal to the spacing of the guides 60. Thus, when the clamping lid 64 is slidingly positioned on the sets of guides 60 which is the guide set closest to the top of the container 50 and yet horizontally above the container 50, rotation of the cam 88 causes the clamping lid 64 to come into contact and clamp the container 50 to the lower shelf 48.

Referring to FIG. 4, the mixing apparatus 20 also includes a mechanism 104 for connecting the inner frame 36 to the intermediate frame 26 and agitating the inner frame 36. The agitating mechanism 104 includes an electric motor 106 which rotates a drive shaft 108 through belt drive 110. The electric motor 106 is fixedly mounted and the drive shaft 108 is rotatably mounted to the intermediate frame 26. Attached along the shaft 108 is a set of counterweights 114, and fixedly attached to each end of the shaft is a rotary linkage 116. In each of the rotary linkages 116, one end of a pin 118 is also fixedly attached. The pin 118 is coparallel with and spaced from axis 108*a* of the drive shaft 108 so that rotation of the drive shaft and hence rotation of the rotary linkage 116 causes the pin to eccentrically rotate about the axis. Preferably the rotary linkages 116 also form integral counterweights 120.

The other end of each of the pins 118 is journalled in bearings 124 which are mounted to apron flanges 126. Each of the apron flanges 126 is attached to the lower braces 44 of the inner frame 36.

Referring to FIG. 3, movement of the upper end of the inner frame 36 relative to the intermediate frame 26 is guided by a pivot linkage 130. Pivot linkage 130 includes a generally horizontal shaft 132 journalled in bearings 134 attached to the inner frame 36 and a generally horizontal shaft 136 journalled in bearings 138 attached to the intermediate frame 26. Opposite ends of elongated linkages 142 are attached to shaft 132 and shaft 136. Because the intermediate frame 26 is relatively fixed, the pivot linkage 130 guides the movement of the upper end of the inner frame 36 so that movement, such as agitation of the lower end of the inner frame is translated into pivotal movement of the upper end of the inner frame.

Referring to FIGS. 1 and 2, in operation, the operator opens hatch door 16 to provide access to the interior of the cabinet 12. The shelf 48 is then pulled forward along the guides 46 until the cam followers 52 (FIG. 3) are engaged to stop the forward progress of the shelf. The container 50 or containers may be placed in an upright position on the upper surface of the shelf 48. The shelf 48 may then be slidingly pushed back along the guides 46. To insure that the assembly 10 is not operated unless the shelf 48 is pushed into a proper position, the shelf 48 and cabinet 12 may be sized so that the hatch door 16 cannot be properly closed unless the shelf is in the proper position.

The clamping lid 64 is then slidingly attached to the desired shelving guide 60. The desired shelving guide 60 is the set of shelving guides which is horizontally closest to the top of the container 50 without being below the top of the container. In a manner similar to the shelf 48, the clamping lid 64 and cabinet 12 are configured so that the hatch door 16 will not close unless the clamping lid is in the proper position on the guide 60. The hatch door 16 is then closed.

The control of the operation of the mixer 10 may be accomplished using several methods; however, in the preferred embodiment, the mixer is operated by a controller 150 as shown schematically in FIG. 1. First the time of operation is selected by manual orientation of a selector switch 152. Preferably the switch 152 may be placed in one of a discrete number of positions representing different agitating periods. In addition, a safety switch 154 may be mounted on the cabinet 12 to prevent operation of the mixing apparatus 20 unless the hatch door 16 is properly closed.

A start switch 156 is then pushed to begin the operation of the mixer 10. The start switch 156 may include a light to indicate when the mixer 10 is operating. Referring also to FIG. 5, the start switch 156 activates the controller 150 which sends a signal to the linear drive device 100 to extend the rod 98. Extension of the rod 98 rotates the linkage 96 and hence the shaft 90 and cams 88. As the cams 88 rotate, the cams contactingly force down the plate 94 and panel 72 and hence the cage 56 toward the container 50. Movement of the panel 72 causes corresponding movement of the guides 60 and clamping lid 64 toward the container 50 until the clamping lid contacts the container and applies a predetermined downwardly directed force on the container. The downwardly directed force clamps the container 50 between the lid 64 and the shelf 48. The attachment between the guides 60 and clamping lid 64 prevents the clamping lid from being upwardly displaced by the contact with the container 50. When the downwardly directed force applied on the container 50 reaches the predetermined level, the slip clutch in the linear drive device 100 prevents further outward extension of the rod 98.

Referring to FIG. 1 and 4, after a preselected time period, corresponding to the time required for the rod 98 to reach its maximum extension, the controller 150 sends a signal to activate the agitating mechanism 104. When the agitating mechanism 104 is actuated, the electric motor 106 rotates the drive shaft 108 (FIG. 4) which in turn rotates rotary linkage 116. Rotation of the rotary linkage 116 propels the pin 118, and therefore, the lower end of the inner frame 36 in an eccentric path about the axis 108*a* of the drive shaft 108. This eccentric travel of the lower end of the inner frame 36 imparts a shaking motion to the inner frame and hence to the shelf 48 and paint container 50. The counter weights 114 and 120 offset the asymmetric loading imposed on the drive shaft 108 by the eccentric travel of the lower end of the inner frame 36.

Movement of the upper end of the inner frame 36 is constrained by pivot linkage 130 (FIG. 3) so that the upper end of the inner frame pivots about the upper end of the intermediate frame 26.

Referring back to FIGS. 1 and 2, the shaking motion of the inner frame 36 transfers vibrations to the intermediate frame 26. The shocks 28, which connect the intermediate frame 26 to the outer frame 24, dampen the vibrations of the intermediate frame to prevent the vibrations from being transferred to the outer frame.

After the agitation period which was selected has elapsed, the controller 150 sends a signal to deactivate the motor 106, stopping the agitation of the inner frame 36. Referring also to FIG. 4, the controller 150 may then send a signal to activate the linear drive device 100 to retract the rod 98, hence rotating the cams 88. As the cams rotate 88, the biasing force applied by the spring 74 on the cage 56 forces the cage, including the clamping lid 64, upward away from the container 50. The container 50 is thereby released from the clamping force. After the rod 98 is fully retracted, the controller 150 sends a signal to turn off the light in the start switch 156. The operator may then open the hatch door 16 and slidingly pull the shelf 48 forward to provide access to the container 50 or containers on the shelf. The containers may then be removed and the process may be repeated for other containers.

The controls 18 may also include an emergency off switch 158, to stop the operation of the agitating mechanism 104 at any time during the operation. In addition, a reset button 160 may be included to be activated after the emergency switch 158 has been pushed and place the mixer 150 back into the status which preceded activation of the start switch 156. The reset button 160 may also include a light to indicate when the reset button has been activated.

A specific embodiment of the novel container shaker according to the present invention has been described for the purposes of illustrating the manner in which the invention may be made and used. It should be understood that implementation of other variations and modifications of the invention in its carious aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

What is claimed:

1. An apparatus for shaking at least one paint container containing paint, the apparatus comprising:

a first frame;

a support means pivotally connected to an end of said first frame;

a shelf connected to said first frame and having an upper surface configured to support the at least one paint container in a generally upright position;

clamping means connected to said first frame for selectively clamping the at least one paint container to said shelf, said clamping means including, a clamping member movable to contact the at least one paint container and clamp the at least one paint container on said shelf, said clamping member having a cage assembly slidably connected to said first frame, said cage assembly including a plurality of guide sets, said clamping member also including a lid configured to selectively slidably engage one of said guide sets to selectively position said lid relative to said cage assembly, a cam operably contacting said clamping member, and means for selectively rotating said cam to move said clamping member toward the at least one paint container; and means for agitating said first frame to mix the paint within the at least one paint container, said agitating means including a means for rotating an opposite end of said first frame about an axis, said opposite end rotating means being attached to said support means.

2. The apparatus of claim 1 further including a third frame and means connecting said third frame to said support means for substantially dampening vibrations of said support means relative to said third frame.

3. The apparatus of claim 1 wherein said means for selectively rotating said cam includes means for stopping a rotational movement of said cam when a force applied by said clamping member on the at least one paint container reaches a desired level.

4. The apparatus of claim 3 wherein said means for selectively rotating said cam includes a linear drive with a slip clutch, said linear drive being operably attached to said cam.

5. The apparatus of claim 1 wherein said cam is rotatably mounted to said first frame.

6. The apparatus of claim 1 wherein said shelf is slidably connected to said first frame.

7. The apparatus of claim 1 further including biasing means operatively contacting said clamping member for exerting a force opposing movement of said clamping member toward said shelf.

8. The apparatus of claim 1 wherein said shelf and said clamping member are configured to clamp a plurality of containers to said shelf.

9. An apparatus for shaking at least one paint container containing paint, the apparatus comprising:

a first frame;

a shelf connected to said first frame and having an upper surface configured to support the at least one paint container in a generally upright position;

clamping means connected to said first frame for selectively clamping the at least one paint container to said shelf, said clamping means including, a clamping member movable to contact the at least one paint container and clamp the at least one paint container on said shelf and having a cage assembly slidably connected to said first frame, said cage assembly including a plurality of guide sets, said clamping member also including a lid configured to selectively slidably engage one of said guide sets to selectively position said lid relative to said cage assembly, cam means operably contacting said clamping member for moving said clamping member upon rotation of said cam means, and a linear drive with a slip clutch operably attached to said cam means to selectively rotate said cam means to move said clamping member toward the at least one paint container; and means for agitating said first frame to mix the paint within the at least one paint container.

10. The apparatus of claim 9 further including a support means pivotally connected to an end of said first frame, said agitating means including a rotary shaft attached to said support means and means, connected to said rotary shaft and an opposite end of said first frame, for rotating said opposite end about an axis of said rotary shaft.

11. The apparatus of claim 9 further including biasing means operatively contacting said cage assembly for exerting a force opposing movement of said cage assembly toward said shelf.

* * * * *